United States Patent [19]

Zanias

[11] 4,442,798

[45] Apr. 17, 1984

[54] VENT ASSEMBLY

[75] Inventor: Theodore J. Zanias, Long Beach, Calif.

[73] Assignee: Masco Corporation, Taylor, Mich.

[21] Appl. No.: 508,424

[22] Filed: Jun. 27, 1983

Related U.S. Application Data

[63] Continuation of Ser. No. 352,186, Feb. 25, 1982, abandoned, which is a continuation of Ser. No. 182,832, Aug. 29, 1980, abandoned.

[51] Int. Cl.[3] ..... F22B 5/00

[52] U.S. Cl. ..... 122/17; 110/147; 110/163; 126/307 R; 126/307 A

[58] Field of Search ..... 110/163, 147, 193; 126/307 R, 307 A, 312; 122/17; 98/98; 236/16, 93 R

[56] References Cited

U.S. PATENT DOCUMENTS

| | | | |
|---|---|---|---|
| 1,945,955 | 2/1934 | Price | 126/307 A |
| 2,165,811 | 7/1939 | Peters | 110/147 X |
| 2,184,983 | 12/1939 | Tornquist | 126/307 A |
| 2,241,661 | 5/1941 | Furlong | 110/147 |
| 2,537,082 | 1/1951 | Palmer | 110/147 |
| 2,704,538 | 3/1955 | Tuck | 126/307 A |
| 3,718,544 | 2/1973 | Sims | 122/17 X |
| 4,215,814 | 8/1980 | Ebert | 126/307 R |

*Primary Examiner*—Edward G. Favors

*Attorney, Agent, or Firm*—Steven L. Permut; E. Dennis O'Connor; Leon E. Redman

[57] ABSTRACT

A vent assembly adapted for venting into the atmosphere hot burner exhaust gases from the flue exhaust port of a heating appliance within an enclosure, such assembly including an exhaust duct and a relief duct. The exhaust duct is connected at one end to said flue exhaust port and is opened at its other end to the ambient atmosphere outside of the enclosure. A selectively responsive closure device, such as a thermally controlled damper, is disposed within the exhaust duct. The relief duct is connected to the exhaust duct at a point along the flow of exhaust gases upstream of the closure device and has a relief aperture disposed at a height between that of the exhaust port and that of the burner.

2 Claims, 2 Drawing Figures

FIG. 1.
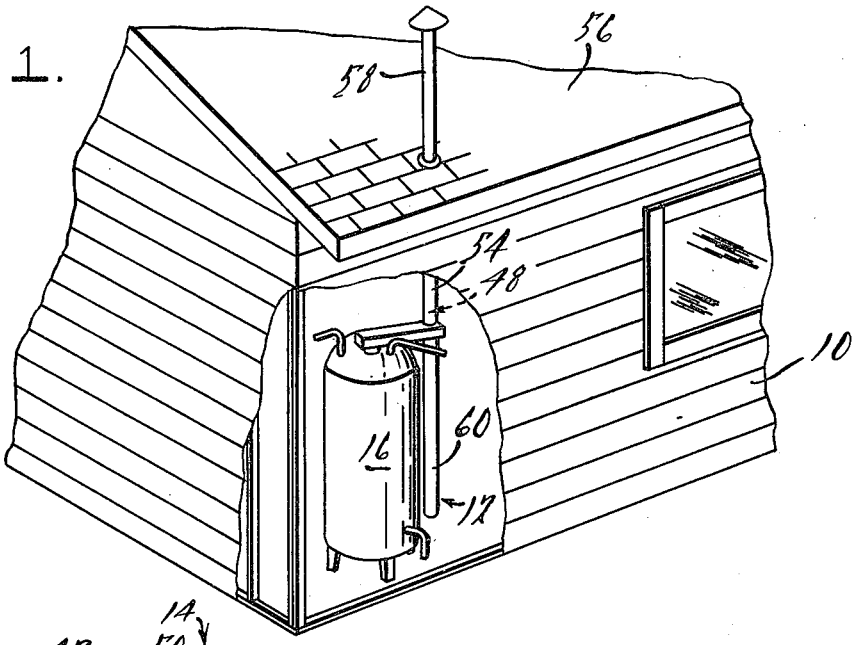
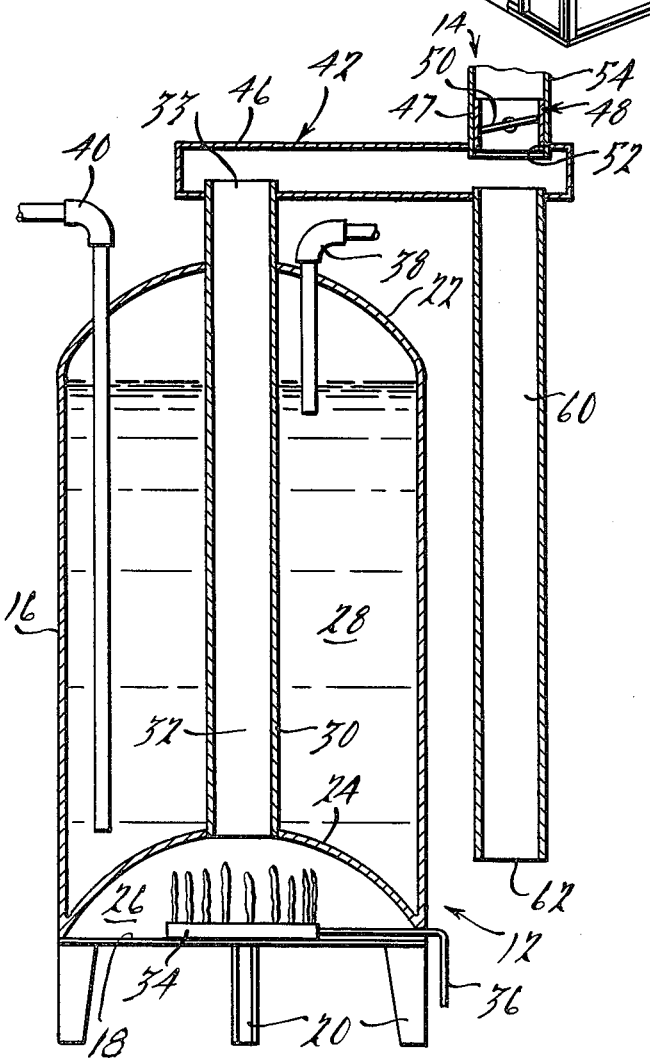
FIG. 2.

VENT ASSEMBLY

This is a continuation of application Ser. No. 352,186, filed Feb. 25, 1982, and now abandoned, which is a continuation of Ser. No. 182,832, filed Aug. 29, 1980, abandoned.

BACKGROUND

The present invention relates to vent assemblies and particularly to vent assemblies for venting exhaust gases from fossil fuel fired appliances, such as gas hot water heaters.

A conventional gas hot water heater consists of a hot water tank above a gas burner and disposes of the products of burner combustion through a central flue or through multiple flues that extend vertically through the tank. The water therefore is heated both by the heat of the flame at the bottom of the tank and by the hot exhaust gases passing through the flue or flues. These hot gases exit each such flue at a flue exhaust port and enter, through a draft hood thereabove, a duct leading to the chimney, thus disposing of the products of combustion into the atmosphere above the building containing the water heater.

Where a heater flue and draft hood come together, one or more relief apertures are provided so that the flue is open to the ambient atmosphere within the building. This is necessary for a number of reasons. In the event of a blockage along the conduit to the chimney, caused, for example, by a bird or raccoon nest, the products of combustion that back up in the chimney would otherwise collect within the flue to the location of the burner, displacing the requisite ambient atmosphere necessary for complete combustion, and in extreme cases collect in such concentrations as to create the possibility of explosion. Instead, the relief apertures allow these gases to spill into the building where they are dispersed. A similar risk avoided by the relief apertures is that risk created during the unusual, but certainly not unknown, occurrence of wind blowing down the chimney.

Unfortunately, the apertures cause a measurable increase in fossil fuel consumption due to an increased loss of heat from the water in the tank and due to a movement of room air up the chimney, room air that has been heated at some expense by the heating plant of the building. Furthermore, the loss of air up the chimney tends to create low pressure within the house, increasing the amount of cold outside air that is drawn into the house through air leaks such as those prevalent around windows and doors. This disadvantage is remedied partly by the installation of a vent damper within the venting system. Such dampers are currently available and may be electromechanically or thermally controlled.

Even with the use of a vent damper, there is still, however, a continuing exchange of heat between the water in the tank and the air within the flue. As the air within the flue becomes heated by this exchange, it naturally forms a convection current and exits from the venting system, either through the chimney or thorugh the draft hood apertures if such a vent damper is closed. This allows a free exchange of air between the flue and the surrounding ambient atmosphere until the heated air is replaced by ambient, cooler air. The cooler room air is drawn into the flue, continuing to cool the water. This cooling by the convection current requires an increased frequency of burner operation to maintain a "hot water ready" condition.

A second damper, located at the exhaust outlet of the flue may be provided to alleviate heat loss due to convection currents through the flue passages of the tank, but the controls for a two damper system are, of necessity, complex. The second damper could not be thermally controlled but must, instead, be electrically or mechanically controlled. This is true because the exhaust outlet of the flue must be opened before ignition of the burner to prevent possible explosion or incomplete combustion. What is required, then, is a system with a plurality of moving parts such as gears, motors, wires or linkages.

It thus is desirable and the object of this invention to provide a vent assembly that accomplishes the same reductions in fuel consumption as provided by a two damper system but retains the economy and safety provided by a single damper system and inherent in using a reduced number of moving parts.

SUMMARY OF THE INVENTION

The present invention offers an improvement over the prior art by providing a vent assembly for a heating appliance that reduces energy consumption by reducing heat loss. The vent assembly of the present invention comprises an exhaust duct or conduit and a relief duct or conduit. The exhaust duct or conduit is attached at one of its ends to the flue exhaust port of the heating appliance and is opened at its other end to the chimney or ambient atmosphere outside the enclosure. A selectively responsive closure device, such as a thermally controlled damper, is disposed within the exhaust conduit, selectively closing the conduit to the flow of air when the burner is off. The relief duct is connected to the exhaust duct at a point upstream of the closure device. A relief aperture in the relief duct is disposed at a height between that of the flue exhaust port and that of the burner.

DESCRIPTION OF THE DRAWINGS

FIG. 1 is a cutaway isometric view of a building containing a heating appliance having a vent assembly according to the present invention and FIG. 2 is a partly schematic side elevation view, taken in section, of the appliance and vent assembly of FIG. 1.

DETAILED DESCRIPTION OF PREFERRED EMBODIMENT

Referring to the drawing, FIG. 1 illustrates a building 10 containing a heating appliance 12, such as a water heater, to which is connected an example of vent diverter assembly 14 according to the present invention. The heating appliance 12 is well known in the art and forms no part of the present invention but is described herein for illustrative purposes.

As shown in FIGS. 1 and 2, the heating appliance 12 comprises a cylindrical outer shell 16 having at its base a flat platform 18 and a plurality of legs 20 supporting the appliance in a location that is a short distance above the floor. The upper portion 22 of the outer shell 16 may be flat or may be curved as shown in the drawing. An inner wall 24, shown as curved, is disposed within the shell 16 and divides the interior of the shell into a pair of vertically spaced chambers: a lower combustion compartment 26 and an upper water storage compartment 28. A cylindrical pipe 30 axially disposed within the shell 16 extends upwardly from the combustion compartment 26 to an exhaust port 33 at or above the top 22 of the outer shell. The pipe 30 defines a flue 32 for the passage of the products of combustion of the burner.

Within the combustion compartment 26 there is disposed a burner 34 which, in the example shown, is a gas burner supplied with fuel by means of a gas inlet pipe 36. The water storage compartment 28 of the heating appliance 12 is supplied with cold water from a cold water inlet pipe 38 and supplies hot water to the plumbing system of the building 10 through an inlet pipe 40. As seen in the drawing, the water in compartment 28 is heated by the flame of the burner 34 and is additionally heated through the heat released by hot exhaust gases as they pass up the flue 32.

It should be noted that in a conventional vent assembly, not shown in the drawing, a draft hood connected to a duct leading upward to a chimney is disposed above the flue exhaust port 33. One or more apertures in a draft hood or an opening between the draft hood and the flue exhaust port 33 allows the exhaust gases and products of combustion from the burner 34 of the appliance 12 to be dispersed within the building 10 in the event of a chimney blockage.

In the preferred embodiment as shown in FIGS. 1 and 2, the vent assembly 14 of the present invention comprises an exhaust duct assembly 42 having an intermediate duct 46 fitted near one of its ends to the pipe 30 at the flue exhaust port 33. A selectively responsive closure device 48, such as a thermally controlled damper as disclosed in the U.S. Pat. No. 3,510,059, is fitted in an aperture 52 in the intermediate duct 46. Such closure devices comprise a cylindrical outer tube 47 and a pivotally mounted damper 50. A pipe or conduit 54 extends upwardly from the closure device 48 through the roof 56 of the building 10 and terminates in a chimney 58. In building structure having masonry or other such chimneys, conduit 54 may lead to such a chimney.

A relief duct 60 is attached to, communicates with and extends downwardly from the intermediate duct 46. The lowermost portion of duct 60 is open and comprises a relief aperture 62. The relief aperture 62 is disposed at a height above that of the burner 34. The relief aperture 62 reduces the likelihood of suffocation of the flame for reasons that will be explained in detail later.

The vent diverter assembly of the present invention operates similarly to some vent assemblies of the prior art during normal operation. When the burner 34 is off, the closure device 48 is closed and therefore allows little or no air to rise past it. As a result, the air within flue 32 which is heated by the water in the tank 28 and the air in the room which has been heated by the heating plant of the building are prevented from escaping up the exhaust duct. Unlike vent assemblies of the prior art, however, the location of the relief aperture 62 is significantly below the flue exhaust port 33. Since the heated air is lighter than the room air, the location of the relief aperture 62 prevents a significant amount of the heated air in the flue 32 from being exchanged with the room air. Therefore, since the rate of heat transfer between the water in the tank and the air in the flue is approximately proportional to the temperature differential between the water and the air, the water in the compartment 28 will not cool down as rapidly as it would with a conventional vent hood. Conceivably, the pilot flame of the burner 34 can supply a sufficient amount of new heat to the water storage compartment 28 to compensate for any heat losses when the burner is not operating such that the burner 34 is rarely fired unless hot water has been drawn from the water heater.

When the burner 34 is fired, the closure means 48 is opened to allow the exhaust gases and products of combustion to escape up the chimney 58. In the case of a thermally responsive damper, the damper 48 opens when the heated gases in the flue rise through the intermediate duct 42 and encounter the damper 48. Alternate closure means, for example, may comprise an electrically actuated damper, not shown, actuated by the same thermostat, also not shown, that starts the burner 34.

As previously noted, there are times during which hot exhaust gases may not freely flow up the chimney 58. These include, for example, the short time interval between start up of the burner and the opening of the closure device 48, or during a blockage of the chimney 58 or a downdraft. During the time that any of these conditions is present, the major portion of exhaust gases and products of combustion from the burner will be diverted to avoid unacceptable accumulation of exhaust gases. Instead, the exhaust gases will first accumulate in the intermediate duct 46. These gases, being warmer than the air within the room, will continue to exert a pressurizing force within duct 46 as the burner operates. Such pressurization within duct 46 will cause the gases to descend through the relief duct 60. The exhaust gases will eventually pass through relief aperture 62 into the room as they accumulate in sufficient volume to displace air in the relief duct 60.

It is desirable to have the relief aperture 62 disposed substantially below the flue exhaust port 33 to reduce the loss of heat during the times that the burner is off and to reduce the amount of exhaust gases and products of combustion spilled into the room during a temporary blockage such as that occuring during a delay in the damper opening or a sudden downdraft. It is critical, however, that the relief aperture 62 be located above the height of the flame of the burner 34 since the gases accumulated during a blockage displace the air both in the flue 33 and in the relief duct 60. Locating the relief aperture above the height of the flame will assure that when the gases accumulate to the extent that they have substantially filled the flue 33, they will also have completely filled relief duct 60 and will begin to leave the duct 60 by means of the relief aperture 62. Locating the relief aperture 62 at or below the neight of the burner 34 would create the risk of suffocation of the burner flames by the exhaust gases and the risk of explosion of incompletely burned gases.

Having thus described the present invention by the means of the best mode contemplated at the time of filing for carrying out the invention, variations thereof will be apparent to those skilled in the art. For example, the ducts may be comprised of metal, ceramic or plastic material and may be of any desired cross-sectional shape.

What is claimed as novel is as follows:

1. A vent assembly for venting into the atmosphere gasses of combustion from a flue exhaust port of a heater appliance disposed within an enclosure and having a burner, a tank disposed above the burner and at least one flue extending vertically through the tank and interconnecting a burner compartment and said flue exhaust port, said vent assembly comprising:

an exhaust duct having two ends, one of said ends being connected to said flue exhaust port and the other of said ends being open to the atmosphere outside said enclosure;

selectively operative closure means selectively opening said duct for the flow of said gasses of combustion therethrough when said burner operation is discontinued;

said selectively operative closure means comprises a thermally responsive damper constructed to respond to the temperature within said duct and opening when gasses within said exhaust duct are above a predetermined temperature;

a relief duct connected to said exhaust duct at a point along the flow path of said gasses of combustion upstream of said closure means; and a continuously open relief aperture in said relief duct disposed at a height between the height of said burner and the height of said flue exhaust port but substantially closer to the height of said burner than to the height of said flue exhaust port.

2. The vent assembly of claim 1 wherein said exhaust duct comprises a first intermediate duct joined to said flue, a second intermediate duct joined to said first intermediate duct, and a chimney duct joined to said second intermediate duct, said relief duct being joined to said first intermediate duct and said closure means being disposed within said second intermediate duct.

* * * * *